US007059903B2

(12) United States Patent
Sasaki et al.

(10) Patent No.: US 7,059,903 B2
(45) Date of Patent: Jun. 13, 2006

(54) CONNECTOR

(75) Inventors: Harehide Sasaki, Aichi-ken (JP); Reiki Okamoto, Aichi-ken (JP); Yoshiaki Kato, Aichi-ken (JP); Masato Minakata, Aichi-ken (JP); Atsushi Nishida, Aichi-ken (JP)

(73) Assignee: Kabushiki Kaisha Tokai-Rika-Denki-Seisakusho, Aichi-Ken (JP)

( * ) Notice: Subject to any disclaimer, the term of this patent is extended or adjusted under 35 U.S.C. 154(b) by 0 days.

(21) Appl. No.: 11/070,292

(22) Filed: Mar. 3, 2005

(65) Prior Publication Data

US 2005/0197009 A1 Sep. 8, 2005

(30) Foreign Application Priority Data

Mar. 5, 2004 (JP) ..... 2004-062248

(51) Int. Cl.
*H01R 13/40* (2006.01)

(52) U.S. Cl. ..... 439/595

(58) Field of Classification Search ..... 439/595, 439/752

See application file for complete search history.

(56) References Cited

U.S. PATENT DOCUMENTS 4,711,509 A * 12/1987 Cross et al. ..... 439/587
5,575,684 A * 11/1996 Uchida et al. ..... 439/595
5,676,562 A * 10/1997 Fukuda ..... 439/329
5,860,835 A * 1/1999 Ohsumi ..... 439/595
5,980,318 A * 11/1999 Morello et al. ..... 439/595

* cited by examiner

*Primary Examiner*—Gary F. Paumen
*Assistant Examiner*—Larisa Tsukerman
(74) *Attorney, Agent, or Firm*—Nixon Peabody LLP

(57) ABSTRACT

A connector enables a size reduction while maintaining a function of reliably preventing terminal members from falling out of terminal holes. In this connector, a plate spring piece is provided in a terminal hole of a connector housing, with a length thereof set to an axial direction of the terminal hole, and an engaging pawl protrudes from the plate spring piece. When a female terminal is inserted into the terminal hole, the engaging pawl engages with the female terminal and bends the plate spring piece downward, enabling the insertion. When the female terminal is inserted to a predetermined depth in the terminal hole, the plate spring piece returns and the engaging pawl moves into an engaging hole of the female terminal. The plate spring piece has a structure of which one length direction end portion and one side portion, along the length direction, are fixed to the connector housing.

11 Claims, 5 Drawing Sheets

CONNECTOR

CROSS-REFERENCE TO RELATED APPLICATION

This application claims priority under 35 USC 119 from Japanese Patent Application No. 2004-62248, the disclosure of which is incorporated by reference herein.

BACKGROUND OF THE INVENTION

1. Field of the Invention

The present invention relates to a connector which is structured by assembling a terminal member to a connector housing, and which connects with another connector.

2. Description of the Related Art

A connector has been structured by assembling terminal members, which are formed of a conductive metallic material, into terminal holes formed in a connector housing, which is formed of an insulative resin material. This connector is connected to a similarly structured other connector for putting the terminal members into states of conductive connection with terminal members of the other connector, such that this state is maintained. The terminal members are assembled to the connector housing such that the terminal members will not fall out from the terminal holes when disengaged from or engaged with the terminal members of the other connector.

As structures for assembling such a terminal member to a connector housing, a terminal lance structure and a housing lance structure are known. A terminal lance structure engages an engaging pawl provided at the terminal member with an engaging portion (a hole, a step portion or the like) formed inside the terminal hole of the connector housing. The housing lance structure engages an engaging pawl provided inside the terminal hole with a hole portion formed through a sleeve wall of a sleeve-like portion of the terminal member.

In a terminal lance structure, a portion of a sleeve wall of the terminal member, which is made of metal, curves out at an angle so as to protrude outward and form the engaging pawl. When the terminal member is being inserted into the terminal hole, this engaging pawl deforms to the sleeve wall side thereof and slides against a hole wall of the terminal hole to allow insertion. When the engaging pawl has passed the engaging portion of the connector housing, the engaging pawl is projected away from the sleeve wall by restoring force of the engaging pawl. Thus, engagement of the engaging pawl with the engaging portion is possible. Hence, the terminal member which has been inserted into the terminal hole is prevented from falling out of the terminal hole.

However, with a terminal lance structure as described above, because the engaging pawl is structured by a portion of the sleeve wall of the terminal member acting as a cantilevered metal piece, the engaging pawl may plastically deform when the terminal member is inserted into the terminal hole. Thus, restoring force may not be sufficient and it may not be possible to ensure an amount of engagement with the engaging portion. An inadequate engaging amount may result in the terminal member falling out from the terminal hole in accordance with connections of the terminal member to other terminal members.

On the other hand, in a housing lance structure, a taper-form engaging pawl is formed at a plate spring piece, which is integrally provided extending from the connector housing in the terminal hole. When the terminal member is inserted into the terminal hole and engages with a taper face of the engaging pawl, the plate spring piece deforms to allow the insertion. Then, when the hole portion of the terminal member reaches a region at which the engaging pawl is provided, the engaging pawl is moved into the hole portion by restoring force of the plate spring piece. Thus, the engaging pawl can be engaged with the hole portion. Hence, the terminal member which has been inserted into the terminal hole is prevented from falling out of the terminal hole.

More specifically, as is shown in FIG. 5, a plate spring piece 54, with length in an axial direction of a terminal hole 52 in a connector housing 50, is integrally provided in the terminal hole 52. The plate spring piece 54 has a cantilever structure, of which an end portion at a side from which an unillustrated terminal member is to be inserted is supported at the connector housing 50. An engaging pawl 56 is provided protruding from a vicinity of a free end of the plate spring piece 54. When the terminal member engages with a taper face 56A of the engaging pawl 56, the plate spring piece 54 bends downward, as shown by the broken lines in FIG. 5, such that insertion of the terminal member into the terminal hole 52 is allowed. Hence, because the plate spring piece 54 which is provided integrally with the connector housing 50 is made of resin, the plate spring piece 54 consistently restores without plastically deforming, and the engaging pawl 56 can be reliably moved into a hole portion of the terminal member. Thus, in regard to characteristics of retention of terminal members in connector housings, the housing lance structure has higher reliability than the terminal lance structure.

Meanwhile, there have been calls for reductions in size of connectors, that is, of connector housings. In particular, there have been strengthening calls for reductions in size of connectors that are employed in vehicles such as cars and the like.

However, with a connector featuring the housing lance structure as described above, it is not possible to reduce thickness of the plate spring piece, because strength of the plate spring piece must be maintained. That is, it is not possible to reduce space in the terminal hole 52 that is occupied by the plate spring piece, including space that is occupied by the plate spring piece in the deformed position (a lance space for engaging the terminal member with the engaging pawl). Thus, there has been a limit on reductions in size of connectors.

Furthermore, in the above-described housing lance structure, the plate spring piece has a cantilever structure, and it is necessary to specify respective gaps between the plate spring piece and two side walls of the terminal hole. Therefore, structure of a mold at a time of molding, that is, a die drawing structure, is complicated, and reductions in size are even more difficult in regard to maintaining strength and spacing of the mold (and of insert pieces thereof).

SUMMARY OF THE INVENTION

In consideration of the circumstances described above, the present invention will provide a connector which enables a reduction in size while maintaining a function of reliably preventing a terminal member from falling out from a terminal hole.

A connector of a first aspect of the present invention includes: a connector housing formed of a resin material, in which a terminal hole is formed; a conductive terminal member including an accommodated portion, which is inserted into the terminal hole along an axial direction of the terminal hole, and a hole portion, which opens at an outer face of the accommodated portion; a plate spring portion fabricated of resin, which is disposed in the terminal hole with a length of the plate spring portion along the axial direction of the terminal hole, both of one length direction end portion of the plate spring portion and one side portion along the length direction being fixed to the connector housing; and a pawl portion protruding from the plate spring portion, the pawl portion engaging with the terminal member that is being inserted into the terminal hole and deforming the plate spring portion for allowing the insertion of the terminal member into the terminal hole, and the pawl portion being moved into the hole portion by restoring of the plate spring portion when the terminal member has been inserted to a predetermined depth in the terminal hole.

The connector of the first aspect is structured by inserting the accommodated portion of the terminal member into the terminal hole of the connector housing. The accommodated portion may be a portion of the terminal member, and the accommodated portion may be the whole of the terminal member. When the terminal member is inserted into the terminal hole from a predetermined direction, the pawl portion engages with the terminal member, and at this time the plate spring portion is deformed. Thus, further insertion of the terminal member into the terminal hole is allowed. That is, the pawl portion converts a portion of a force of insertion of the terminal member into a force for deformation of the plate spring portion. Hence, when the terminal member is inserted to the predetermined depth in the terminal hole, the hole portion of the terminal member reaches a location that corresponds with the pawl portion, and the pawl portion moves into the hole portion as a consequence of restoring of the plate spring portion, such that the pawl portion can engage with the hole portion of the terminal member. As a result, the terminal member is prevented from falling out from the terminal hole. Herein, the hole portion may be a hole having a bottom (a recess portion), and may be a through-hole.

Now, the plate spring portion, which is fabricated of resin, reliably restores without plastically deforming, and reliably causes the pawl portion to sufficiently move into the hole portion of the terminal member. Thus, it is possible to assuredly prevent the terminal member from falling out of the terminal hole. Further, because the one length direction end portion of the plate spring portion and the one side portion of the plate spring portion along the length direction are fixed to the connector housing, it is possible to assure strength even if the plate spring portion is made thinner. Therefore, by making the plate spring portion thinner, it is possible to reduce space for provision of the plate spring portion in the terminal hole, including space for the deformed position at the time of insertion of the terminal member, and it is possible to reduce size of the connector housing and thus of the connector.

Accordingly, with the connector of the first aspect, it is possible to reduce size while maintaining the function of reliably preventing the terminal member from falling out from the terminal hole.

A connector of a second aspect of the present invention includes: a connector housing formed of a resin material; a fitting portion which fits with another connector; and a plurality of connector portions provided at the fitting portion, wherein each of the plurality of connector portions includes: a conductive terminal member including an accommodated portion, which is inserted into a terminal hole formed in the connector housing along an axial direction of the terminal hole, and a hole portion, which opens at an outer face of the accommodated portion; a plate spring portion fabricated of resin, which is disposed in the terminal hole with a length of the plate spring portion along the axial direction of the terminal hole, both of one length direction end portion of the plate spring portion and one side portion along the length direction being fixed to the connector housing; and a pawl portion protruding from the plate spring portion, the pawl portion engaging with the terminal member that is being inserted into the terminal hole and deforming the plate spring portion for allowing the insertion of the terminal member into the terminal hole, and the pawl portion being moved into the hole portion by restoring of the plate spring portion when the terminal member has been inserted to a predetermined depth in the terminal hole.

A connector relating to the present embodiment as described above provides an excellent effect in that it is possible to reduce size while maintaining a function of reliably preventing a terminal member from falling out from a terminal hole.

DETAILED DESCRIPTION OF THE INVENTION

Figure 1B:
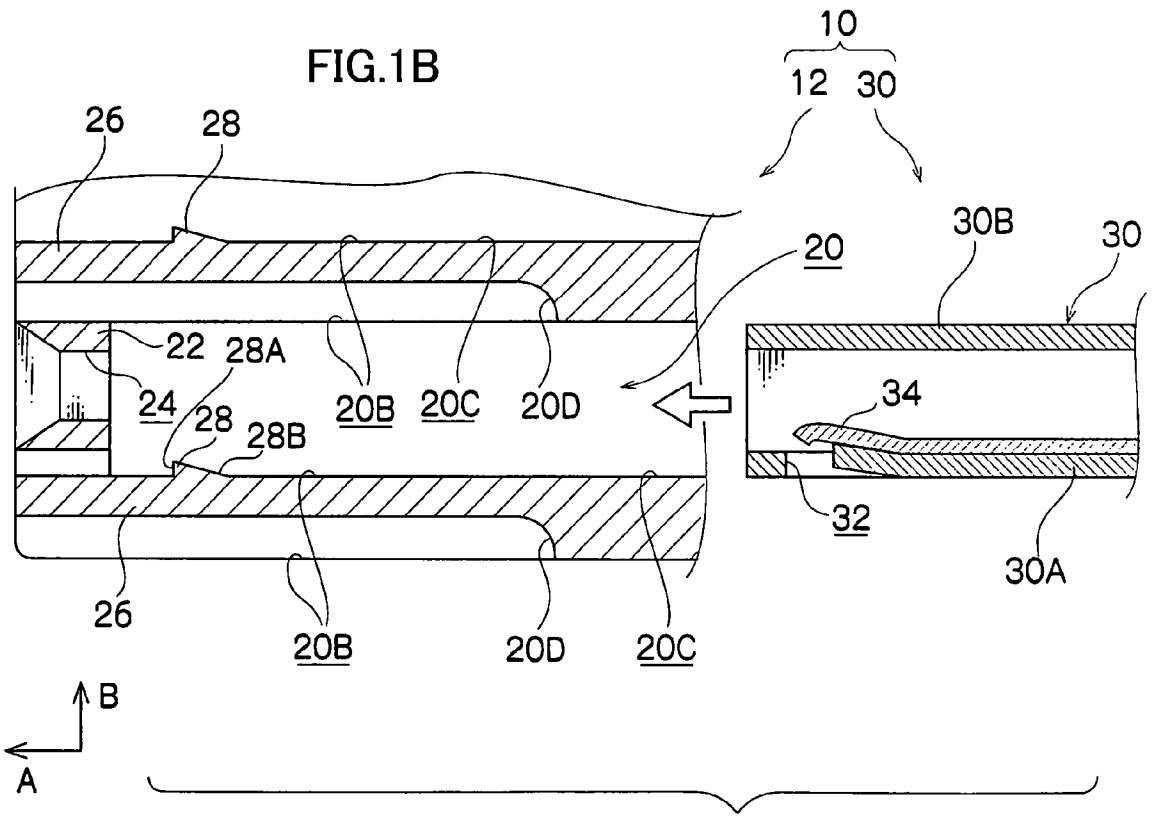
FIG. 1B is a side sectional view of a process of insertion of a female terminal into a terminal hole, which shows an enlargement of principal elements of the connecter relating to the embodiment of the present invention.

A connector 10 relating to an embodiment of the present invention will be described with reference to FIGS. 1 to 4. For the sake of convenience, in the following descriptions, a direction shown by an arrow A where appropriate in the drawings is referred to as forward, and directions shown by an arrow B and an arrow C, which intersect arrow A, are referred to as upward and rightward, respectively.

Figure 2A:
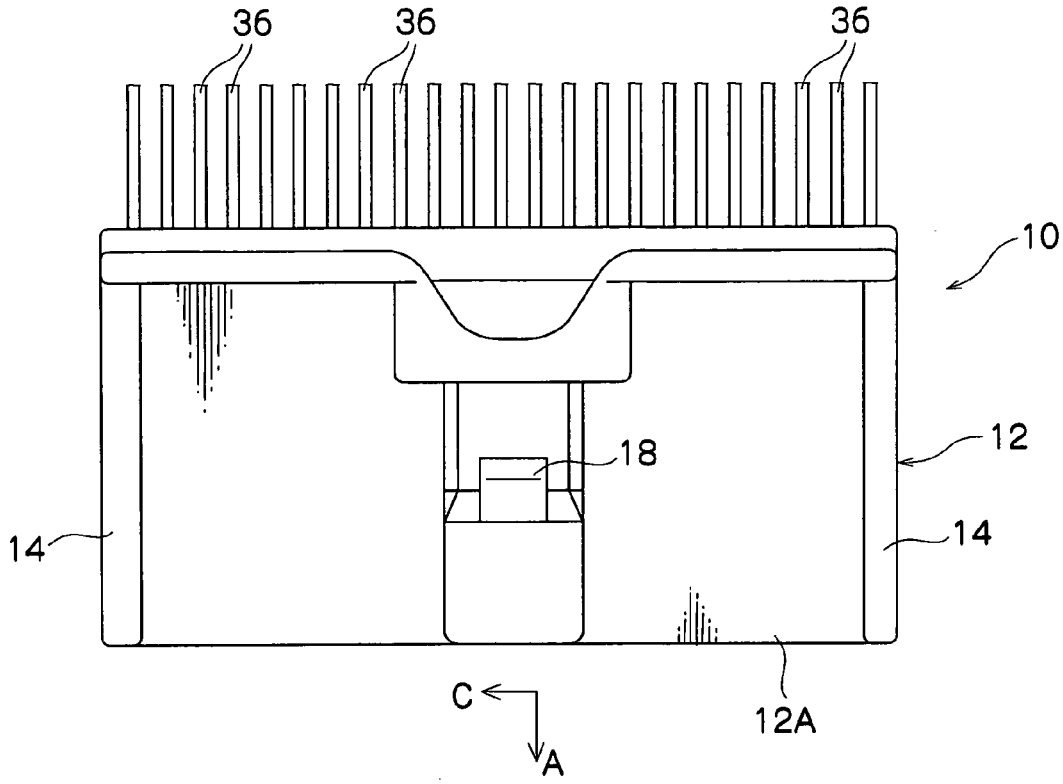
FIG. 2A is a plan view showing schematic overall structure of the connecter relating to the embodiment of the present invention.
Figure 2B:
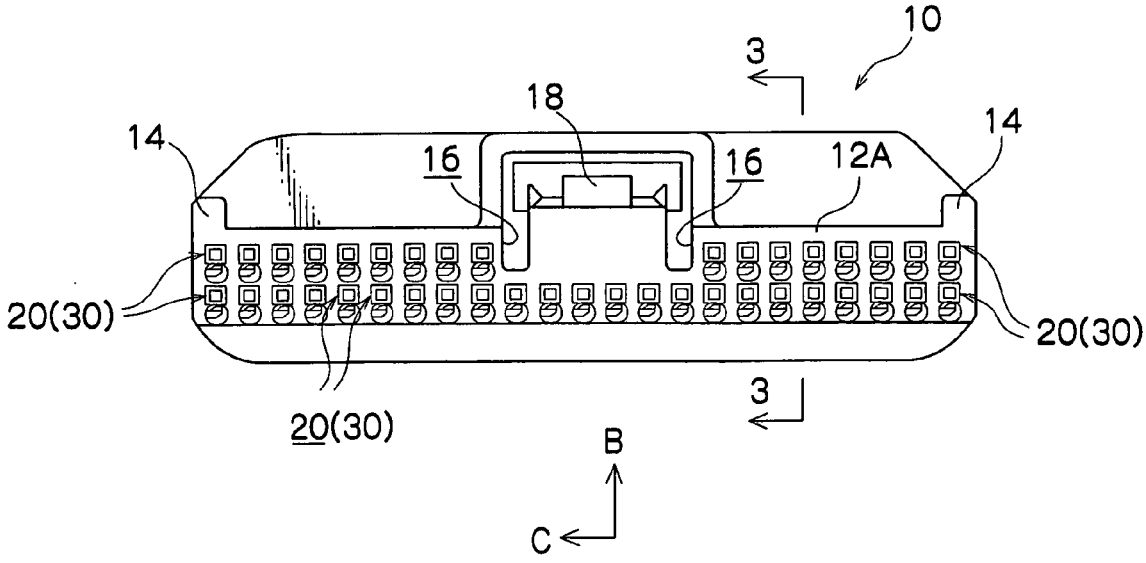
FIG. 2B is a front view showing the schematic overall structure of the connecter relating to the embodiment of the present invention.

FIG. 2A shows a plan view of the connector 10, and FIG. 2B shows a front view of the connector 10.

As shown in these drawings, the connector 10 is equipped with a connector housing 12. A front portion of the connector housing 12 is formed as a fitting portion 12A, at which another connector, which is not shown, will be inserted. Specifically, in the present embodiment, the connector 10 serves as a female connector. The connector housing 12 is also provided with a pair of guide protrusion portions 14, a pair of guide recess portions 16, an anchoring projection 18 and so forth. The guide protrusion portions 14 are protrudingly provided along the front-rear direction at left and right ends of the connector housing 12, and are for guiding the other connector (to prevent misinsertion). The guide recess portions 16 are recessedly provided along the front-rear direction at two regions of a substantially central portion in the left-right direction of the connector housing 12, and are for guiding the other connector (to prevent misinsertion). The anchoring projection 18 is provided between the pair of guide recess portions 16 and is for anchoring the other connector.

Figure 3:
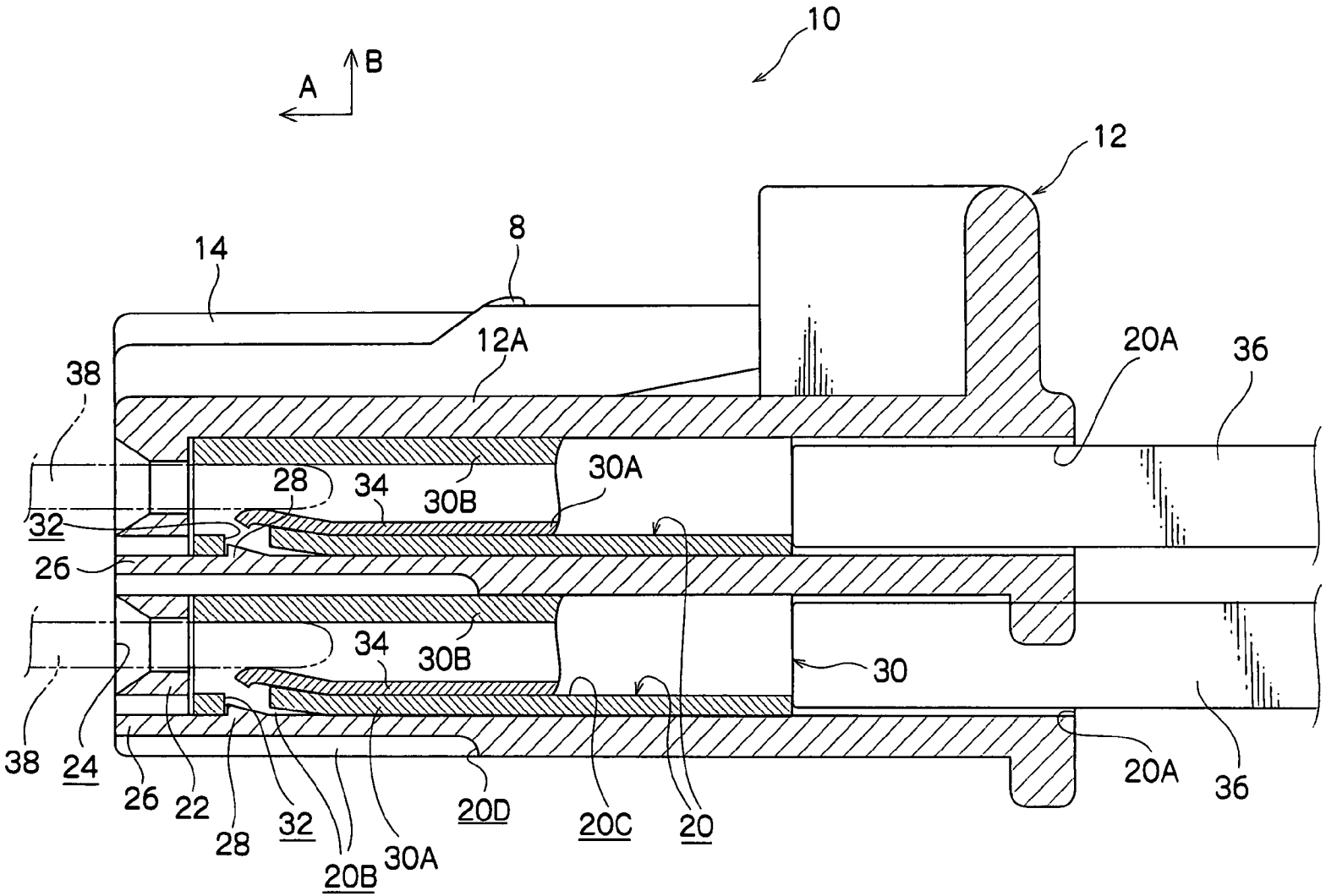
FIG. 3 is a side sectional view cut along line 3—3 of FIG. 2B.

As shown in FIG. 3, terminal holes 20 are formed in the connector housing 12. The terminal holes 20 are formed as terminal holes which are long in the front-rear direction. The plural terminal holes 20, aligned along the left-right direction, are formed at an upper level and a lower level. In the present embodiment, the terminal holes 20 are not provided at the upper level between the pair of guide recess portions 16. The terminal holes 20 are each formed with a cross-sectional form which is a substantially rectangular shape with length in the vertical direction. Female terminals 30, which serve as terminal members, are accommodated in the respective terminal holes 20.

A rear end of each terminal hole 20 is formed as an aperture portion 20A, which opens at a rear face of the connector housing 12. The female terminal 30 is inserted through this aperture portion 20A, and a wire 36 connected to the female terminal 30 for conductive connection is out through the aperture portion 20A. At a front end of the terminal hole 20, an upper portion thereof is closed off by a stopper wall 22, which is provided along a front face of the connector housing 12. The stopper wall 22 is formed so as to match up with a front end portion of the female terminal 30, and thus restrict forward movement of the female terminal 30. A plug hole 24 is formed in this stopper wall 22. The plug hole 24 is for a male terminal 38 of the other connector (see FIG. 3) to pass through into the terminal hole 20.

Figure 4:
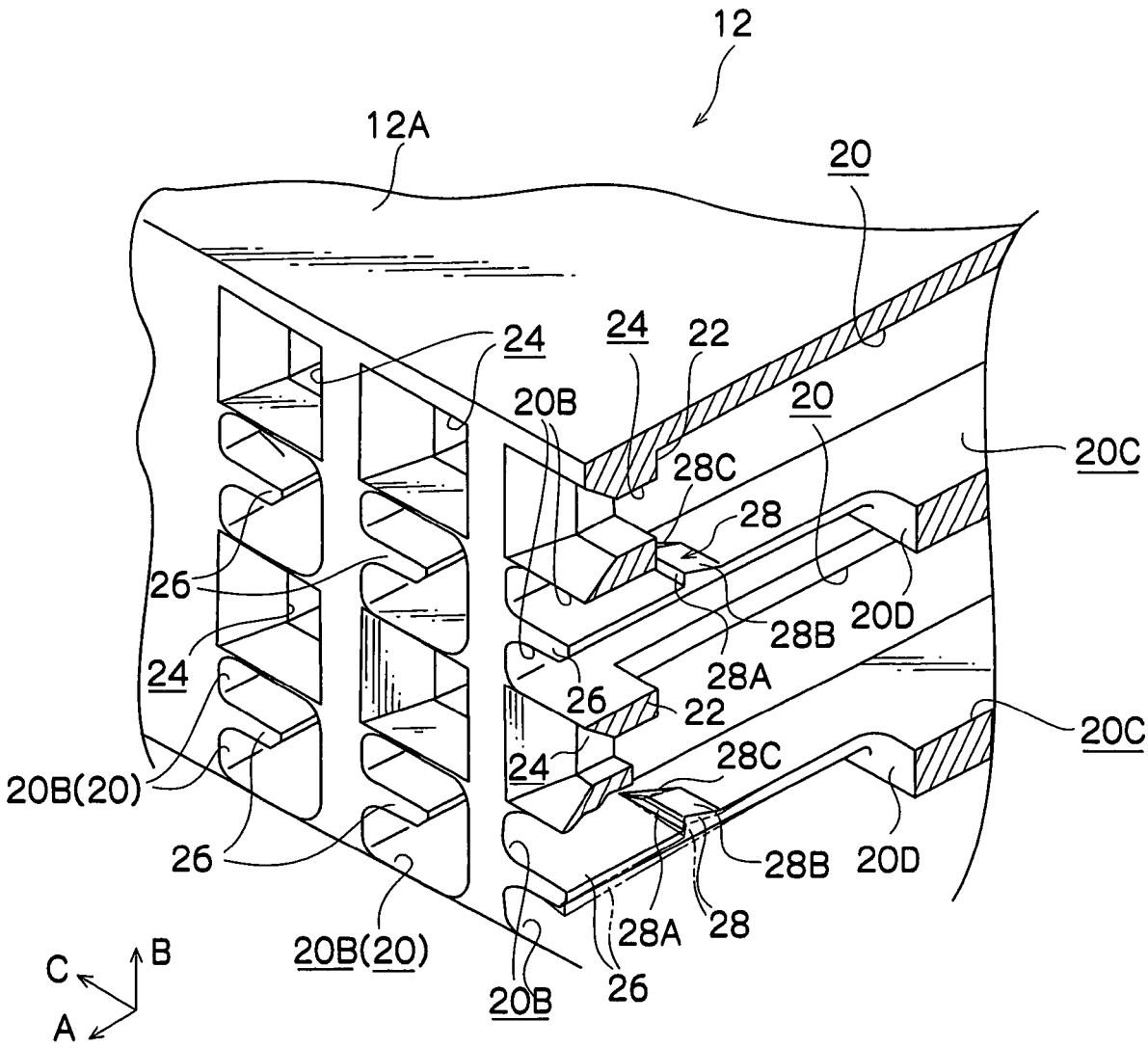
FIG. 4 is an enlarged perspective view of a connector housing which structures the connecter relating to the embodiment of the present invention, viewed with a partial cutaway.
Figure 5:
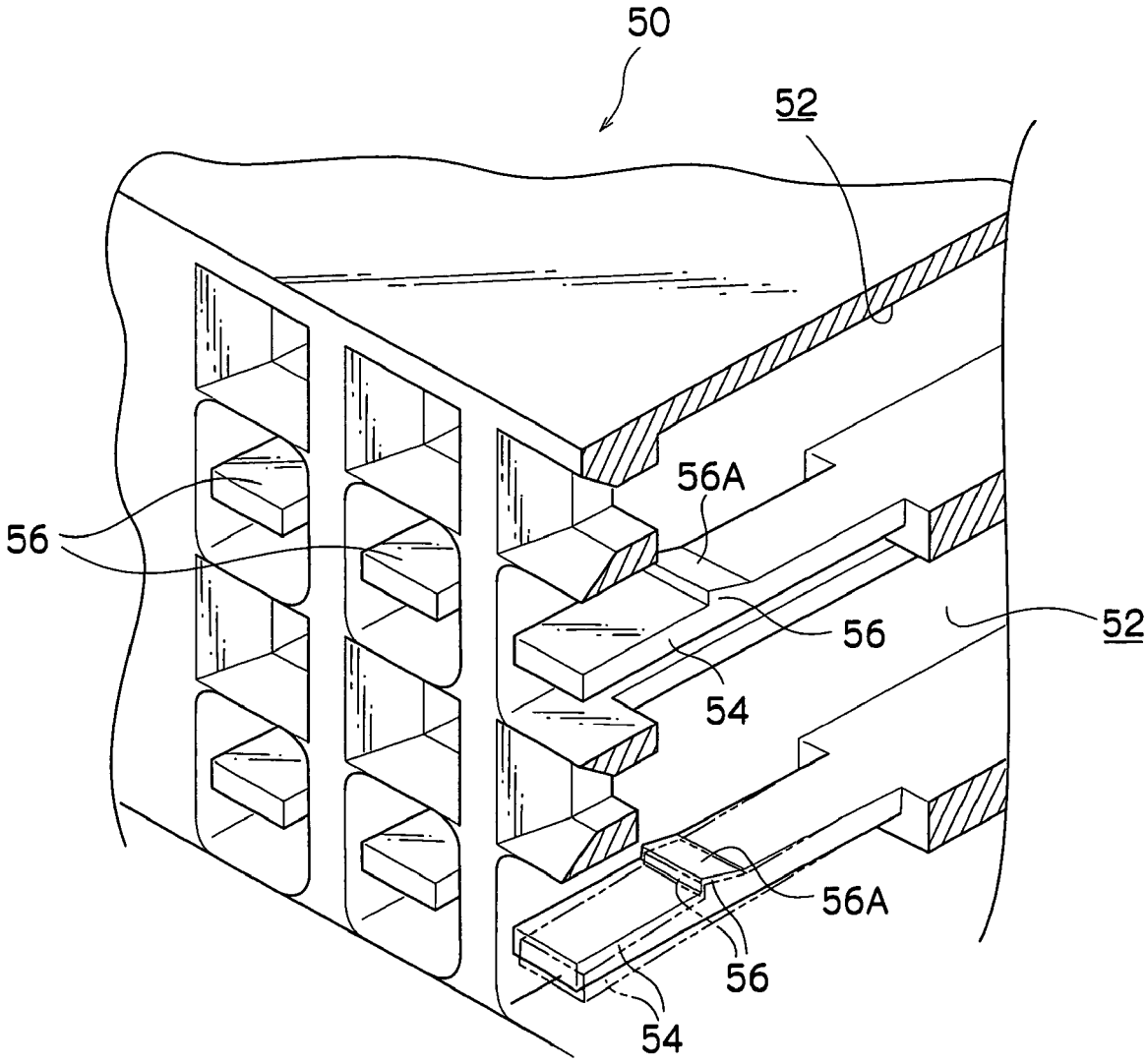
FIG.5 RELATED ART
FIG. 5 is an enlarged perspective view of a connector housing which structures a conventional connecter, viewed with a partial cutaway.

As shown in FIG. 4, a lower portion of a front portion of the terminal hole 20 is formed as a spring provision portion 20B. The spring provision portion 20B opens at the front face of the connector housing 12 and also opens downward over a predetermined length in the length direction of the terminal hole 20. That is, the spring provision portions 20B of the terminal holes 20 of the upper level communicate with upper portions of the terminal holes 20 of the lower level (rearward of the stopper wall 22), and the spring provision portions 20B of the terminal holes 20 of the lower level open at a lower face of the connector housing 12. Hereafter, a portion of the terminal hole 20 that is at the rearward side relative to the spring provision portion 20B will be referred to as a terminal hole rear portion 20C.

As shown in FIG. 1B and FIG. 4, plate spring pieces 26, each of which serves as a plate spring portion, are provided in the spring provision portions 20B of the terminal holes 20. Each plate spring piece 26 is formed in a rectangular flat plate form with length in the front-rear direction, and is disposed such that a plate thickness direction thereof coincides with the vertical direction. A base end portion of each plate spring piece 26 serves as a boundary portion between the spring provision portion 20B and the terminal hole rear portion 20C. That is, the plate spring piece 26 is provided extending forward from a step portion 20D, which is formed between the terminal hole rear portion 20C and the spring provision portion 20B for broadening the terminal hole 20 toward the downward side. A front end of each plate spring piece 26 is formed as a free end, which is substantially coplanar with the front face of the connector housing 12.

The plate spring piece 26 is provided extending forward from an upper portion of the step portion 20D and is formed with a structure such that, in a natural state, an upper face of the plate spring piece 26 acts as a flat face which is coplanar with a bottom face of the terminal hole rear portion 20C. Further, each female terminal 30 is formed so as to rest along the upper face of the corresponding plate spring piece 26 and the bottom face of the terminal hole rear portion 20C when in the terminal hole 20. Accordingly, each plate spring piece 26 is disposed at a vertical direction central portion of the corresponding spring provision portion 20B, and a space in the spring provision portion 20B below the plate spring piece 26 forms an escape space which allows for deformation of the plate spring piece 26.

Figure 1A:
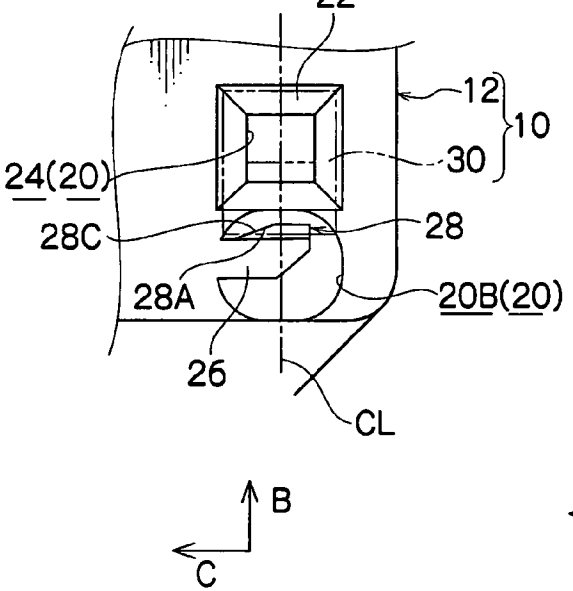
FIG. 1A is a front view showing an enlargement of principal elements of a connecter relating to an embodiment of the present invention.

Further, as shown in FIG. 1A and FIG. 4, a side portion of the right side of each plate spring piece 26 along the length direction thereof is integrated with a right side hole wall of the spring provision portion 20B of the terminal hole 20. In other words, the plate spring piece 26 is provided protruding leftward from the hole wall which defines a right periphery of the corresponding spring provision portion 20B. Meanwhile, a left side side portion of the plate spring piece 26 is formed as a free end, which specifies a gap between the plate spring piece 26 and a hole wall which defines a left periphery of the spring provision portion 20B. Further, at a lower portion of the left side side portion of the plate spring piece 26, a chamfer is formed along substantially the whole length of the plate spring piece 26, in consideration of strength of a mold (insert piece) for forming the plate spring piece 26.

As described above, a rear end portion and a right side portion of each plate spring piece 26 are fixedly integrated with the connector housing 12. Thus, the plate spring piece 26 is made capable of elastically deforming (bending) such that a front-left corner portion thereof moves substantially vertically, as shown by the broken lines in FIG. 4.

Engaging pawls 28, each of which serves as a pawl portion, are provided protruding from the upper faces of the plate spring pieces 26. Each engaging pawl 28 is disposed slightly rearward of the respective stopper wall 22, and is formed so as to enter into an engaging hole 32 (which is described later) of the female terminal 30, forward movement of which is limited by the stopper wall 22. As shown in FIG. 1B, the engaging pawl 28 is formed with a substantially triangular cross section in side view. A front end of the engaging pawl 28 is formed as an engaging face 28A (a front face), which is a surface which is substantially perpendicular to the upper face of the plate spring piece 26. An upper face of the engaging pawl 28 is formed as a taper face 28B, which is continuously inclined such that a protrusion height thereof from the plate spring piece 26 becomes lower toward a rear end of the taper face 28B (i.e., the taper face 28B faces upward and rearward). The rear end of the engaging pawl 28 substantially coincides with the upper face of the plate spring piece 26, with the protrusion height from the upper face of the plate spring piece 26 being set to substantially zero thereat.

At the engaging pawl 28, a protrusion height of the engaging face 28A is set to be greater than a difference between a height of the terminal hole 20 (i.e., a height from the upper face of the plate spring piece 26 in the natural state to a roof face of the terminal hole 20) and a height of the female terminal 30. Thus, in the state in which the engaging pawl 28 has moved into the engaging hole 32, the female terminal 30 is prevented from falling out from the terminal hole 20. That is, a structure is formed such that, if the female terminal 30 that has been properly accommodated in the terminal hole 20 acts to move out to the aperture portion 20A side, the engaging face 28A of the engaging pawl 28 will abut against a front side of the engaging hole 32.

Further, the taper face 28B of the engaging pawl 28 is formed such that, in accordance with the movement of insertion of the female terminal 30 into the terminal hole 20, the taper face 28B slides against a lower portion of a front end vicinity of the female terminal 30 and converts a portion of a force of forward movement of the female terminal 30 into a force for bending the plate spring piece 26 downward. Hence, at this structure, the front end portion of the female terminal 30 passes over the engaging pawl 28 and is inserted into the terminal hole 20 to a predetermined depth. Then, when the engaging hole 32 of the female terminal 30 reaches to above the engaging pawl 28, the plate spring piece 26 is returned to its natural state by restoring force thereof, and the engaging pawl 28 is moved into the engaging hole 32.

As shown in FIG. 1A, each engaging pawl 28 is disposed across a center line CL, which runs along the vertical direction, of the corresponding terminal hole 20, and the engaging pawl 28 is set such that left-right direction widths of a lower front end thereof (a boundary between the front end of the engaging pawl 28 and the plate spring piece 26) at the two sides of the center line CL are substantially equal. A left end face of the engaging pawl 28 is set to be substantially coplanar with a left end face of the plate spring piece 26, which is the free end. Accordingly, a right end portion of the engaging pawl 28 is disposed at a distance from the hole wall that defines the right periphery of the terminal hole 20.

Further, as shown in FIG. 4, the right end portion of each engaging pawl 28 is formed as a taper surface 28C (a side face), a protrusion height of which from the plate spring piece 26 becomes continuously lower toward the right side. A rear end of each taper surface 28C is formed in a triangular shape in plan view so as to substantially match up with a rear-right end of the taper face 28B, which is substantially rectangular in plan view. Thus, the taper surface 28C is formed to face rightward, upward and rearward. A left periphery of the taper surface 28C in the front-rear direction, that is, a right periphery of the taper face 28B, is disposed at the right side relative to the center line CL (see FIG. 1A).

That is, the engaging pawl 28 has a structure which is formed in a substantially triangular prism shape and which is integrally provided with a portion formed in a substantially triangular pyramid shape at a right side of a portion which implements the function of preventing the female terminal 30 from falling out and the function of converting movement force of the female terminal 30 into deformation force of the plate spring piece 26, as described above. Consequently, a left-right width of a lower front portion of the engaging pawl 28 is assured and strength is maintained, while a protrusion height of a right end portion of the engaging pawl 28 is restrained. Thus, in the state in which the front-left corner portion of the plate spring piece 26 is bent so as to move downward, the right end portion of the engaging pawl 28 does not prevent forward movement of the female terminal 30.

The connector housing 12 described above is integrally formed as a resin member including the plate spring pieces 26 and the engaging pawls 28. That is, the plate spring pieces 26 and the engaging pawls 28 are respectively formed of resin material and are provided integrally to the connector housing 12.

Meanwhile, the female terminals 30 are formed in square tube shapes which correspond with the forms of inner peripheries of the terminal holes 20 (i.e., of portions of the spring provision portions 20B excluding portions at lower sides relative to the plate spring pieces 26), and the female terminals 30 are inserted and retained in the terminal holes 20, one-for-one, to structure the connector 10. As shown in FIG. 3, the whole length of each female terminal 30 is inserted into the terminal hole 20, and the female terminal 30 as a whole corresponds to an accommodated portion of the present invention.

Each engaging hole 32 is provided to open downward at a front end vicinity of a floor plate 30A of the female terminal 30, to serve as a hole portion. In the present embodiment, the engaging hole 32 is formed to pass through the floor plate 30A. However, the engaging hole 32 may be formed as, for example, a recess portion which is indented into the floor plate 30A (a hole having a bottom). A distal end of each wire 36 is connected to the rear end of the respective female terminals 30 in a conductive state, by crimping or the like. Thus, the wire 36 is led out from the aperture portion 20A of the terminal hole 20 to outside the connector 10, as described above.

Further, a plate spring 34 is integrally provided to protrude to the interior of the female terminal 30 from a front portion of the floor plate 30A. When the male terminal 38 advances into the female terminal 30 through the corresponding plug hole 24, the plate spring 34, in an elastically deformed state, nips the male terminal 38 between the plate spring 34 and a ceiling plate 30B of the female terminal 30. That is, the female terminal 30 has a structure which makes contact with the male terminal 38 by pressure due to urging force of the plate spring 34, and the female terminal 30 is connected to the male terminal 38 in a conductive state.

Next, operation of the present embodiment will be described.

For assembly of the connector 10 with the structure described above, the respective female terminals 30, to which the wires 36 are connected, are inserted in the forward direction (the direction of arrow A) through the corresponding aperture portions 20A into the terminal holes 20 of the connector housing 12. When the lower portion of the front end of each female terminal 30 abuts against the taper face 28B of the engaging pawl 28, the taper face 28B slides against the female terminal 30 which is moving forward and converts some of the forward movement force of the female terminal 30 into a force for bending the plate spring piece 26 downward, thus bending the plate spring piece 26 downward. Hence, the front end portion of the female terminal 30 passes over the engaging pawl 28 and moves further forward.

When the female terminal 30 has been inserted to the predetermined depth, the engaging hole 32 of the female terminal 30 reaches to above the engaging pawl 28, and the state of contact between the engaging pawl 28 and the female terminal 30 is released. In consequence, the plate spring piece 26 restores from the above-mentioned bendingly deformed state to the natural state thereof. As a result, the engaging pawl 28 moves into the engaging hole 32 of the female terminal 30. In this state, the female terminal 30 is prevented from moving forward by the stopper wall 22 and is prevented from moving rearward by the engaging face 28A of the engaging pawl 28 which is disposed to be engageable with a front periphery portion of the engaging hole 32. Thus, the female terminals 30 are assembled to the connector housing 12 to be incapable of falling out.

Assembly of the connector 10 is completed by performing the above operation for all of the female terminals 30 (and terminal holes 20), simultaneously, sequentially or the like.

Now, the plate spring piece 26, which is fabricated of resin material, restores without plastically deforming and sufficiently and reliably causes the engaging pawl 28 to enter into the engaging hole 32 of the female terminal 30, and the plate spring piece 26 can reliably prevent the female terminal 30 from falling out from the terminal hole 20. Further, because the length direction rear end portion of the plate spring piece 26 is integrated with the connector housing 12 at the step portion 20D and the right side portion of the plate spring piece 26 along the length direction is integrated with the connector housing 12 at the hole wall of the terminal hole 20, it is possible to make the plate spring piece 26 thinner while maintaining a strength required for implementing the functions mentioned above. Therefore, it is possible to make the spring provision portion 20B (that is, a space for provision of the plate spring piece 26, allowing for the deformation thereof required for these functions) in the terminal hole 20 smaller, and to reduce an exterior size of the connector housing 12, that is, of the connector 10.

Thus, with the connector 10 relating to the present embodiment, it is possible to achieve a reduction in size while maintaining the function of reliably preventing the female terminals 30 from falling out of the terminal holes 20.

Further, in the connector 10, because the plate spring pieces 26 and engaging pawls 28 made of resin are formed integrally with the connector housing 12, fabrication is simple. Further still, because the right side portion along the length direction of the plate spring piece 26, which is long in an axial direction of the terminal hole 20, is integrated with the hole wall which defines the right periphery of the terminal hole 20 in the connector housing 12, that is, because there is no need to provide a gap between the right side of the plate spring piece 26 and the hole wall of the terminal hole 20, a mold (insert piece) structure for forming the plate spring piece 26 is simplified. That is, it is possible to form the connector housing 12 including the plate spring pieces 26 with a mold structure which is simpler than in convention.

Further, in the connector 10, because the protrusion height of the upper face of the right end portion of the engaging pawl 28, which right end portion serves as the taper surface 28C, from the plate spring piece 26 is suppressed, this right end portion will not obstruct forward movement of the female terminal 30 in the state in which the front-left corner portion of the plate spring piece 26 has been bent so as to move downward. Further, because this right end portion is provided, width of the engaging pawl 28, that is, a cross-sectional area of a base portion which is a boundary between the plate spring piece 26 and the engaging pawl 28, is made larger, and strength of the engaging pawl 28 is assured.

Now, in the embodiment described above, a structure has been exemplified which accommodates and retains the female terminals 30 wholly in the terminal holes 20 of the connector housing 12. However, the present invention is not limited thus. For example, it is possible to retain a male terminal, of which a plug portion which is to be plugged into a female terminal of another connector protrudes out of the connector housing or out of the terminal hole, in the connector housing by causing an engaging pawl (the engaging pawl 28 provided at the plate spring piece 26) to enter into a hole portion of the male terminal. Thus, the connector of the present invention is not limited to a female connector as illustrated in the embodiment described above, and may be a male connector.

Further again, the embodiment described above has a structure in which the plate spring piece 26 including the engaging pawl 28 is formed integrally with the connector housing 12. However, the present invention is not limited thus. For example, in a structure in which the number of terminal holes 20 is relatively small, a rear end portion and a right side portion of the plate spring piece 26 may be fixed (integrated) to the connector housing 12 by tight fitting to the plate spring piece 26, adhesion or the like.

Further yet, the embodiment described above has a structure in which protrusion heights of the right end portion of the engaging pawl 28 are lower than protrusion heights of other portions. However, the present invention is not limited thus. For example, in a structure in which the female terminal 30 or the like that is accommodated is relatively large, a structure is possible in which the engaging pawl 28 does not feature a portion corresponding to the right end portion (such as a lower side portion of the taper surface 28C).

Further still, the embodiment described above has a structure in which the front end of the plate spring piece 26 reaches as far as the front periphery of the terminal hole 20. However, the present invention is not limited thus. For example, a structure is possible in which a portion of the plate spring piece 26 at the forward side relative to the engaging pawl 28 has been eliminated.

Herein, in the connector of the present invention, the plate spring portion and the pawl portion may be formed integrally with the connector housing.

In such a connector, because the plate spring portion and the pawl portion, which is provided protruding from the plate spring portion, fabricated of resin are formed integrally with the connector housing fabricated of resin, fabrication is simple. Further, one side portion along the length direction of the plate spring portion, which is long in the axial direction of the terminal hole, is integrated with one wall portion of the terminal hole of the connector housing. In other words, it is sufficient that a gap is specified between another side portion of the plate spring portion and another hole wall of the terminal wall, such that the other side portion acts as a free end. Therefore, structure of a mold is simpler.

Further yet, in the connector of the present invention, the protrusion height of the pawl portion may be made lower at the side of the side portion of the plate spring portion that is fixed to the connector housing than at other portions of the pawl portion.

In this connector, the protrusion height of the pawl portion at the side of the side portion at the fixed side is set to be lower than the other portions thereof in accordance with the deformation, so as to maximize displacement of a corner portion of a length direction other end (distal end) of the side portion of the plate spring portion that is not fixed to the housing (i.e., to maximize a bending amount). Consequently, it is possible to reliably move the pawl portion into the hole portion of the terminal member without impeding insertion of the terminal member into the terminal hole, while maintaining a width of the pawl portion that is required for strength.

What is claimed is:

1. A connector comprising:

a connector housing formed of a resin material, in which a terminal hole is formed;

a conductive terminal member including an accommodated portion, which is inserted into the terminal hole along an axial direction of the terminal hole, and a hole portion, which opens at an outer face of the accommodated portion;

a plate spring portion fabricated of resin, which is disposed in the terminal hole with a length of the plate spring portion along the axial direction of the terminal hole, only both of one length direction end portion of the plate spring portion and one side portion along the length direction being fixed to the connector housing; and a pawl portion protruding from the plate spring portion, only the pawl portion engaging with the terminal member that is being inserted into the terminal hole and deforming the plate spring portion for allowing the insertion of the terminal member into the terminal hole, and the pawl portion being moved into the hole portion by restoring of the plate spring portion when the terminal member has been inserted to a predetermined depth in the terminal hole.

2. The connector of claim 1, wherein the plate spring portion and the pawl portion are formed integrally with the connector housing.

3. The connector of claim 1, wherein a protrusion height of the pawl portion from the plate spring portion is lower at a side thereof of the one side portion of the plate spring portion that is fixed to the connector housing than at another portion of the pawl portion.

4. The connector of claim 1, wherein the pawl portion comprises:

a front face which is substantially perpendicular to a face, from which the pawl portion protrudes, of the plate spring portion;

an upper face which is substantially rectangular in plan view, the upper face being continuously inclined such that, in a direction opposite to the direction of insertion of the terminal member, a protrusion height of the pawl portion from the plate spring portion becomes lower; and a side face disposed, relative to the front face and the upper face, at a side of the one side portion of the plate spring portion that is fixed to the connector housing, a protrusion height of the side face from the plate spring portion becoming continuously lower toward the side of the one side portion of the plate spring portion that is fixed to the connector housing, and the side face including a substantially triangular shape in plan view.

5. The connector of claim 4, wherein the side face is disposed at a distance from the connector housing.

6. The connector of claim 1, wherein the terminal member comprises a hollow form, which corresponds with an inner periphery form of the terminal hole, and includes a female terminal member.

7. The connector of claim 1, wherein the terminal member comprises a floor plate.

8. The connector of claim 7, wherein the hole portion comprises a through-hole passing through the floor plate.

9. The connector of claim 7, wherein the hole portion comprises a recess portion indented into the floor plate.

10. The connector of claim 1, wherein the pawl portion comprises a portion with a height which is greater than a difference between an interior height of the terminal hole and a height of the accommodated portion.

11. A connector comprising:

a connector housing formed of a resin material;

a fitting portion which fits with another connector; and a plurality of connector portions provided at the fitting portion, wherein each of the plurality of connector portions includes, a conductive terminal member including an accommodated portion, which is inserted into a terminal hole formed in the connector housing along an axial direction of the terminal hole, only and a hole portion, which opens at an outer face of the accommodated portion, a plate spring portion fabricated of resin, which is disposed in the terminal hole with a length of the plate spring portion along the axial direction of the terminal hole, only both of one length direction end portion of the plate spring portion and one side portion along the length direction being fixed to the connector housing, and a pawl portion protruding from the plate spring portion, the pawl portion engaging with the terminal member that is being inserted into the terminal hole and deforming the plate spring portion for allowing the insertion of the terminal member into the terminal hole, and the pawl portion being moved into the hole portion by restoring of the plate spring portion when the terminal member has been inserted to a predetermined depth in the terminal hole.

* * * * *